United States Patent [19]

Stout

[11] 4,226,703

[45] Oct. 7, 1980

[54] ELECTRO-STATIC TOBACCO SEPARATOR

[75] Inventor: Stephen E. Stout, Wilson, N.C.

[73] Assignee: Imperial Group Limited, Bristol, England

[21] Appl. No.: 932,853

[22] Filed: Aug. 11, 1978

[51] Int. Cl.[2] ..... B03C 7/04

[52] U.S. Cl. ..... 209/127 B; 209/129

[58] Field of Search ..... 131/121, 146, 109 B; 209/127 R, 127 B, 129, 131

[56] References Cited

U.S. PATENT DOCUMENTS

| | | | |
|---|---|---|---|
| 2,848,108 | 8/1958 | Brastad et al. | 209/127 R |
| 3,402,814 | 9/1968 | Morel et al. | 209/127 R |
| 3,458,040 | 7/1969 | Schmid | 209/127 R |
| 3,837,481 | 9/1974 | Stungis et al. | 131/121 X |

FOREIGN PATENT DOCUMENTS

| | | | |
|---|---|---|---|
| 687595 | 2/1940 | Fed. Rep. of Germany | 209/127 R |
| 1374308 | 11/1974 | United Kingdom | 209/127 R |

*Primary Examiner*—Ralph J. Hill

*Attorney, Agent, or Firm*—Larson, Taylor and Hinds

[57] ABSTRACT

An electro-static tobacco separator is provided in which fine tobacco particles are separated from sand particles by passing the mixture along a vibratory conveyor wherein a voltage is impressed across the conveyor and a grid disposed above the conveyor. The lighter tobacco particles are attracted by the oppositely charged grid and passed upwardly into a separate trough which is also vibrated, so that the tobacco particles and sand are separately discharged at the discharge end of the conveyor.

3 Claims, 3 Drawing Figures

ELECTRO-STATIC TOBACCO SEPARATOR

BACKGROUND OF THE INVENTION

This invention relates to an electro-static tobacco separator, wherein fine tobacco particles can be separated from a mixture with equal size sand particles.

In the processing of tobacco, there is a byproduct which is termed offal. This offal consists of sand and tobacco particles sieved from the product during the various stages of processing and manufacture. It is desirable to recapture the tobacco fines for reuse as in reconstituted tobacco. However, difficulty has been encountered in separating the tobacco particles from sand, as it is only the tobacco fraction which is of value, and any sand present is destructive to reconstituting equipment.

Heretofore, one type of separator utilizes a fluidized bed, such as shown in U.S. Pat. No. 3,402,814. In this type of separator, a mixture of grains are given the same polarity with a collector disposed above the fluidized bed and an electro-static field extending between the fluidized bed and the collector. The grains are distinguished by their conductivity as they may be conductive or insulating, of different weight or differentially chargeable. The difficulty with this system is that the charge holding capacity of tobacco is extremely short-lived and furthermore, in the arrangement shown in the above mentioned patent, there is no provision for continuous operation with the continual removal of the light fraction from the heavy fraction.

Another type of separator involves using an induced air flow above a fluidized bed to sweep away the lighter fraction of particles which is airborne. However, the equipment and energy requirements for this type of equipment adds considerably to both the initial cost and the operating cost of the system. Thus, such an induced air flow arrangement has not proven ideal for the separation of fine tobacco particles from sand.

According to the present invention, there is provided a conventional vibrating conveyor, wherein a portion of the conveyor is enclosed and provided with a grid spaced a predetermined distance above the feeder pan. A separate conveyor or trough is disposed immediately adjacent the grid and extends beyond the discharge end of the feeder pan. The feeder pan and grid are oppositely charged and a mixture of sand and tobacco particles is fed onto the feeder pan. As the lighter tobacco particles become charged, they pass upwardly to the oppositely charged grid and drop into the trough disposed adjacent the grid. This trough is also vibrated so as to move the tobacco particles towards the discharge end of the trough. Tobacco particles which do not fall into the trough are recycled and a substantially complete separation of the tobacco particles from the sand is effected by the time the mixture reaches the discharge end of the feeder pan. The system is inexpensive, provides different discharge points for the sand and the tobacco particles and may be operated on a continual basis.

An object of the present invention is to provide an electro-static tobacco separator in which fine tobacco particles can be separated from sand particles while the mixture is passing along a conventional vibrating conveyor.

Another object of the present invention is to provide an electro-static tobacco separator in which a grid is placed above and parallel to a conventional vibrating conveyor and the conveyor and grid are oppositely charged so that the lighter tobacco particles of a mixture of tobacco and sand particles will pass from the conveyor upwardly to the grid and will be trapped in a trough provided adjacent the grid.

Other objects and many of the attendant advantages of the present invention will become more readily apparent upon consideration of the following detailed specification, when considered in connection with the accompanying drawing, wherein;

DETAILED DESCRIPTION OF INVENTION

Figures 1, 2, 3:
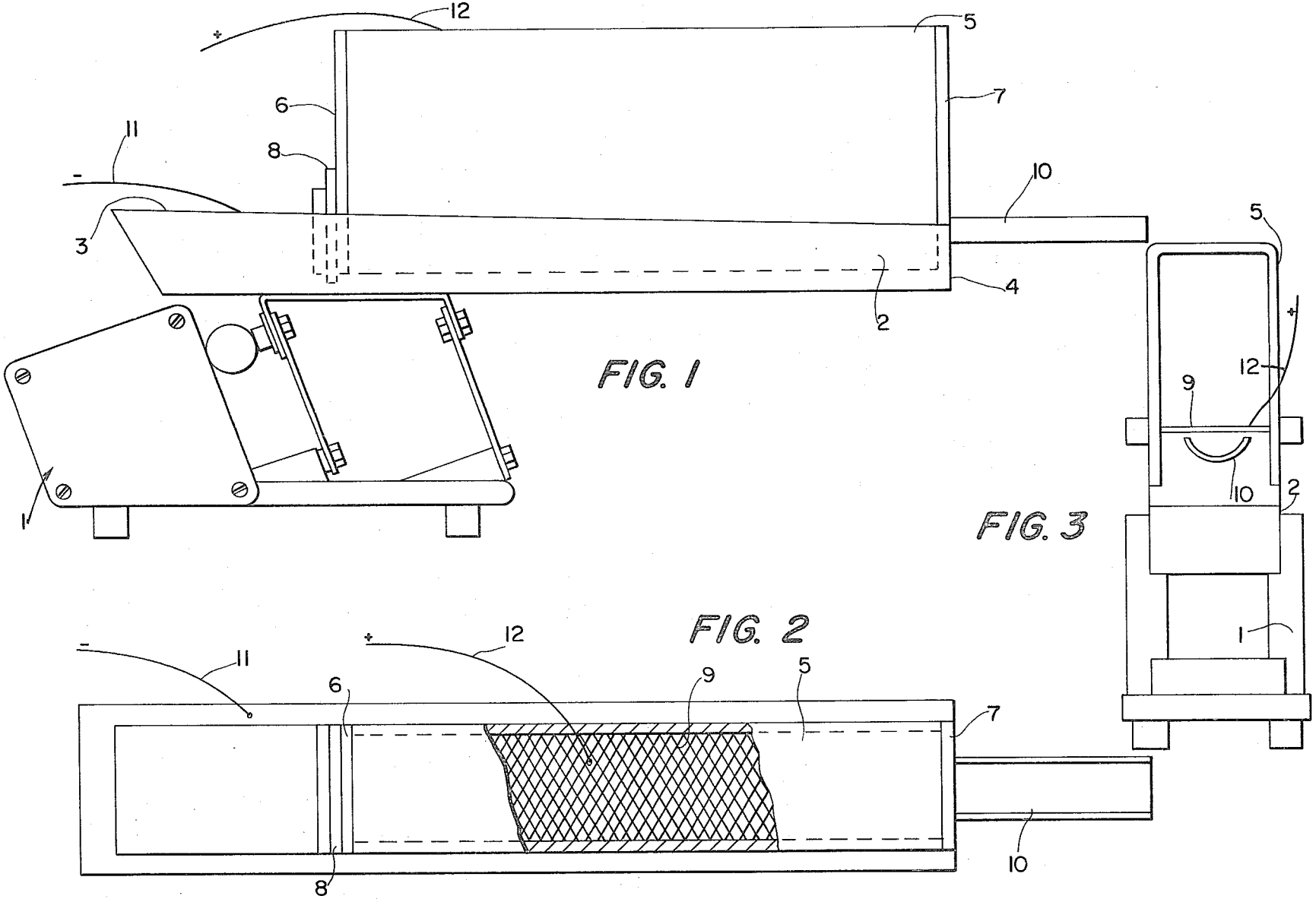
FIG. 1 is a side elevation of the electro-static tobacco separator according to the present invention.
FIG. 2 is a plan view of the separator shown in FIG. 1 with a portion of the cover removed and, FIG. 3 is an end elevation thereof from the right end of FIG. 1.

There is shown in FIG. 1 at 1 a conventional vibrator which is utilized to convey product along a conveyor path. This vibrator may be of any well known type such as a Syntron, which operates at 3600 HZ, 0.100″ amplitude maximum. The vibrator may be equipped with a speed control. Mounted on the vibrating platform is a flanged feeder pan 2. The mixture of tobacco particles and sand which are to be separated are fed to the feed end 3 of feeder pan and the separation of the tobacco particles and sand takes place during the course of passage of the particles as they are vibrated down the feeder pan to the discharge end 4 of the pan.

There is provided a U-shaped cover 5 for the major portion of the length of the feeder pan. This cover is constructed of an insulated material and, most desirably is made of transparent material such as plexiglass. The ends of the cover may be closed by end plates 6 and 7, if desired, and in addition an adjustable feed regulator 8 may be mounted in a mounting therefor in end plate 6. By moving the door or feed regulator 8 up and down, the opening between the lower edge of this member and the horizontal surface of the feed pan 2 may be adjusted and in this way the amount of feed material admitted to the separator may be regulated.

Mounted on the sidewalls of the cover member 5 is a conductive grid 9 which grid is shown in partial plan view in FIG. 2. This grid extends along the entire length of the cover 5 and may be spaced approximately one inch from the bottom of the feeder pan 2. Most conveniently, the grid may comprise a $\frac{1}{4}$″ by $\frac{1}{4}$″ hardware cloth, although any suitable equivalent material may be used.

Mounted in any convenient manner such as by plastic cement or the like on the end walls 6 and 7 of the cover 5 is a trough 10. The trough is of an insulating material and may, if desired, be also constructed of plexiglass. The trough can be disposed either above or below the grid 9, but in the embodiment shown, the trough is disposed immediately below the grid and extends from the end wall 6 through the end wall 7 well beyond the discharge end 4 of the feeder pan 2. As seen in FIG. 3, the trough does not extend the full width of the grid 9 and is disposed across the center portion of the grid with the side portions of the grid providing free passage of material from the feeder pan 2 upwardly into the cover 5. Since the trough is mounted on the hood or cover 5 and the hood is mounted on the feed pan 2, the vibrator 1 vibrates the trough 10 also to move any material disposed therein towards the discharge end of the trough.

Electrical connections 11 and 12 are provided for connecting the electro-static tobacco separator to a voltage supply (not shown). The feeder pan 2 is connected via connector 11 to one terminal of the voltage supply and the connector 12 is connected from the grid 9 to the terminal of opposite polarity of the D.C. voltage supply. Thus, a voltage of, for example, 20,000 volts may be impressed between the grid 9 and feeder pan 2. A rheostat (not shown) may be provided for the voltage supply to regulate the voltage impressed across the separator to any desired level.

In operation, the mixture of sand and tobacco particles to be separated are fed to the feed end 3 of the feeder pan 2. A voltage is impressed between the grid 9 and the feeder pan and the vibrator 1 is energized to move the particles of tobacco and sand along the conveyor or feeder tray 2. The gate or door 8 is adjusted to regulate the quantity of material to be separated into the chamber formed by the cover 5. The sand and tobacco particles acquire the charge of the feeder pan and the lighter tobacco particles pass upwardly through the grid 9, being attracted by the oppositely charged grid. Some of these particles fall into the trough 10 and these tobacco particles move along the trough to the discharge end by the vibration of the trough from vibrator 1. The tobacco particles which do not fall into through 10 acquire the charge of the grid and pass downwardly back into the feed pan 2. These particles again acquire the charge of the pan and pass upwardly through the grid, this cycle continuing until substantially all of the tobacco particles are disposed in the trough with the heavier sand particles remaining in the feeder pan. Thus, at the discharge end the sand particles are discharged at end 4 of feeder pan 2 whereas the tobacco particles are separately discharged from the end of trough 10.

While the electro-static tobacco separator may be made in any desired size, it effectively separates sand from tobacco particles so that the tobacco particles may be made up in sheets of reconstituted tobacco to recover product that would otherwise be lost. The separation according to the present invention is cost efficient in that in one model of the invention 8 to 10 pounds of product was separated in one hour utilizing only 30 watts of power.

Obviously, many modifications and variations of the present invention are possible in light of the foregoing teachings.

What is claimed as new and is desired to be secured by Letters Patent is:

1. A continuous electro-static separator for (a particulate material) separating lighter and heavier particulate material such as tobacco fines and sand comprising, in combination, a vibrating conveyor for receiving the particulate material at one end thereof, and for conveying particles material by vibratory motion, said conveyor forming a lower charged electrode;

a vibrating open mesh grid such as hardware cloth operatively connected to said vibrating conveyor, said vibrating grid forming an upper oppositely charged electrode which is spaced from and electrically isolated from said vibrating conveyor;

a trough of insulating material disposed adjacent the underside of said vibrating grid, said trough having a width substantially less than that of said vibrating grid, and said trough being operatively connected to said lower vibrating conveyor to convey by vibratory motion any particulate material located in said trough;

means for applying a voltage between said vibrating conveyor and said vibrating grid to provide a field for electro-static separation;

such that as said vibrating conveyor receives and conveys the particulate material, the particulate material picks up the charge of said vibrating conveyor causing the lighter particles of the particulate material to be attracted to said oppositely charged vibrating grid where the charge of the lighter particles is lost and whereby some of the lighter particles then fall back towards said vibrating conveyor and are collected in said trough and conveyed away while those lighter particles reaching said vibrating conveyor are again subject to being raised and ultimately collected in said trough.

2. An electro-static separator according to claim 1, further including an insulating rigid hood enclosing said vibrating conveyor, said vibrating grid, and said trough, said hood acting to operatively connect said vibrating conveyor with both said vibrating grid and said trough such that the vibrating movement of said vibrating conveyor is transmitted to both said vibrating grid and said trough.

3. An electro-static separator according to claim 1, wherein said trough extends substantially parallel to said vibrating conveyor and the discharge end of said trough extends beyond the discharge end of said vibrating conveyor.

* * * * *